US010851741B1

(12) United States Patent
Ness et al.

(10) Patent No.: US 10,851,741 B1
(45) Date of Patent: Dec. 1, 2020

(54) AIR CLEANER BACKING PLATE ASSEMBLY WITH CRANKCASE BREATHER VENTS

(71) Applicant: Arlen Ness Enterprises, Inc., Dublin, CA (US)

(72) Inventors: Cory A. Ness, Alamo, CA (US); Phillip B. Mitchell, Jr., Loomis, CA (US); Jeffrey D. Border, San Ramon, CA (US)

(73) Assignee: Arlen Ness Enterprises, Inc., Dublin, CA (US)

( * ) Notice: Subject to any disclaimer, the term of this patent is extended or adjusted under 35 U.S.C. 154(b) by 71 days.

(21) Appl. No.: 16/139,692

(22) Filed: Sep. 24, 2018

Related U.S. Application Data

(60) Provisional application No. 62/713,429, filed on Aug. 1, 2018.

(51) Int. Cl.
*F02M 35/04* (2006.01)
*F02M 35/10* (2006.01)
*F02M 35/16* (2006.01)

(52) U.S. Cl.
CPC ..... *F02M 35/048* (2013.01); *F02M 35/042* (2013.01); *F02M 35/10222* (2013.01); *F02M 35/162* (2013.01)

(58) Field of Classification Search
CPC ..... F02M 35/048; F02M 35/042; F02M 35/10222; F02M 35/162
USPC ..... 123/572
See application file for complete search history.

(56) References Cited

U.S. PATENT DOCUMENTS 5,233,967 A * 8/1993 Peller ..... F01M 13/00 123/572
5,503,649 A * 4/1996 Nickel ..... F02M 35/10222 55/321
6,374,815 B1 * 4/2002 Ness ..... F01M 13/022 123/198 E
2011/0232983 A1 * 9/2011 Abe ..... F02M 35/02416 180/68.3
2013/0220257 A1 * 8/2013 James ..... F02M 35/048 123/184.21

* cited by examiner

*Primary Examiner* — Joseph J Dallo
*Assistant Examiner* — Yi-Kai Wang
(74) *Attorney, Agent, or Firm* — Ice Miller LLP

(57) ABSTRACT

An air cleaner backing plate for coupling to an engine disclosed herein includes a first side to be coupled to an engine and a second side opposite the first side. The backing plate further includes an intake aperture to be aligned with an air intake port of the engine and a tube coupled to the backing plate. The backing plate may further include a reservoir and/or a circular attachment coupled thereto.

20 Claims, 7 Drawing Sheets

AIR CLEANER BACKING PLATE ASSEMBLY WITH CRANKCASE BREATHER VENTS

RELATED APPLICATIONS

This application claims priority benefit of U.S. Provisional Application No. 62/713,429 filed Aug. 1, 2018, which is hereby incorporated in its entirety herein by reference.

BACKGROUND

The examples provided herein relate to engines, for example, internal combustion engines for automobiles and/or motorcycles, and, more particularly, to air cleaner base assemblies that couple an air cleaner to a carburetor or fuel injection system and provide conduits for venting blow-by gases from the crankcase into an air intake thereof or a reservoir attached thereto.

As internal combustion engines wear, the annular spaces between the pistons and the cylinder tend to increase. In the combustion chamber of each cylinder, an air-fuel mixture is ignited. The expanding gas mixture forces the piston away from the engine head or closed end of the cylinder (typically generally downward in most reciprocating internal combustion engine configurations) generating power in the engine. In the expansion process, part of the gas mixture is forced through the annular spaces between the piston and the cylinder into the crankcase. These "blow-by" gases, which also include oil mist (which can coalesce into droplets) and unburned fuel, accumulate in the crankcase and must be vented from the crankcase to the atmosphere to prevent a potentially dangerous pressure build-up in the crankcase.

Pollution control laws and regulations restrict the emissions from internal combustion engines. As exhaust gases from internal combustion engines have become cleaner, the blow-by gases have become a more significant fraction of the total pollution generated by internal combustion engines. In many localities, the pollution control laws and regulations are such that vapors from the crankcase of internal combustion engines must be cleaned prior to discharge into the atmosphere. One method of reducing the pollution associated with the blow by gases is to recycle the gases through the engine. In some four-cycle, two-cylinder engines manufactured by Harley-Davidson, crank case venting and cleaning is accomplished by a crankcase breather system that conducts blow-by gases from the crankcase to an air cleaner, from which the gases are recirculated back into the engine through the carburetor for burning in the engine cylinders. A crankcase breather system is also used for engines employing a fuel injection system.

By way of example, in Harley-Davidson four-cycle, two-cylinder engines, each cylinder includes a pair of push rods that extend from the crankcase into the cylinder head for operating the intake and exhaust valves. Each of the push rods is disposed within a hollow push rod tube that communicates with the crankcase (i.e., provides a passageway for blow-by gases in the crankcase). Upper ends of the push rod tubes communicate with a chamber in the middle rocker box of each cylinder head. On each downstroke of the piston in each cylinder, an umbrella valve attached to a center rocker spacer opens, permitting blow-by gases to pass into the middle chamber. From the middle chamber, the blow-by gases are conducted to a second, upper chamber in the rocker box, and thence, via passageways, through a pair of spaced-apart, threaded holes in a right side of the cylinder heads. The threaded holes in combination with hollow bolts enable a stock plastic backing plate to be secured to the cylinder heads. The hollow bolts provide a passageway for the blow-by gases to vent from the holes in the cylinder heads. In a stock version of the Harley Davidson engine with a carburetor, a stock plastic carburetor backing plate is provided to conduct the blow-by gases from the hollow bolts to an air cleaner element.

To improve and customize engine performance, many purchasers of Harley Davidson motorcycles owners remove and discard the stock carburetor and backing plate system and replace it with a substitute crankcase breather system. These substitute crankcase breather systems can improve air flow to the engine and thereby can significantly improve the horse power of the engine within certain operational ranges.

Some substitute crankcase breather systems vent blow-by gases, which contain oil and fuel mist, directly into the air cleaner, resulting in premature fouling of the air cleaner which substantially increases replacement frequency of the air cleaner. Other substitute crankcase breather systems vent blow-by gasses from multiple cylinder heads in a manner that causes them to interfere with one another. For example, where blow-by gases are vented into a common channel, the portions vented during the piston downstroke in one cylinder can interfere with the outflow of blow-by gases from the other cylinder during its piston upstroke.

DETAILED DESCRIPTION

Figure 1:
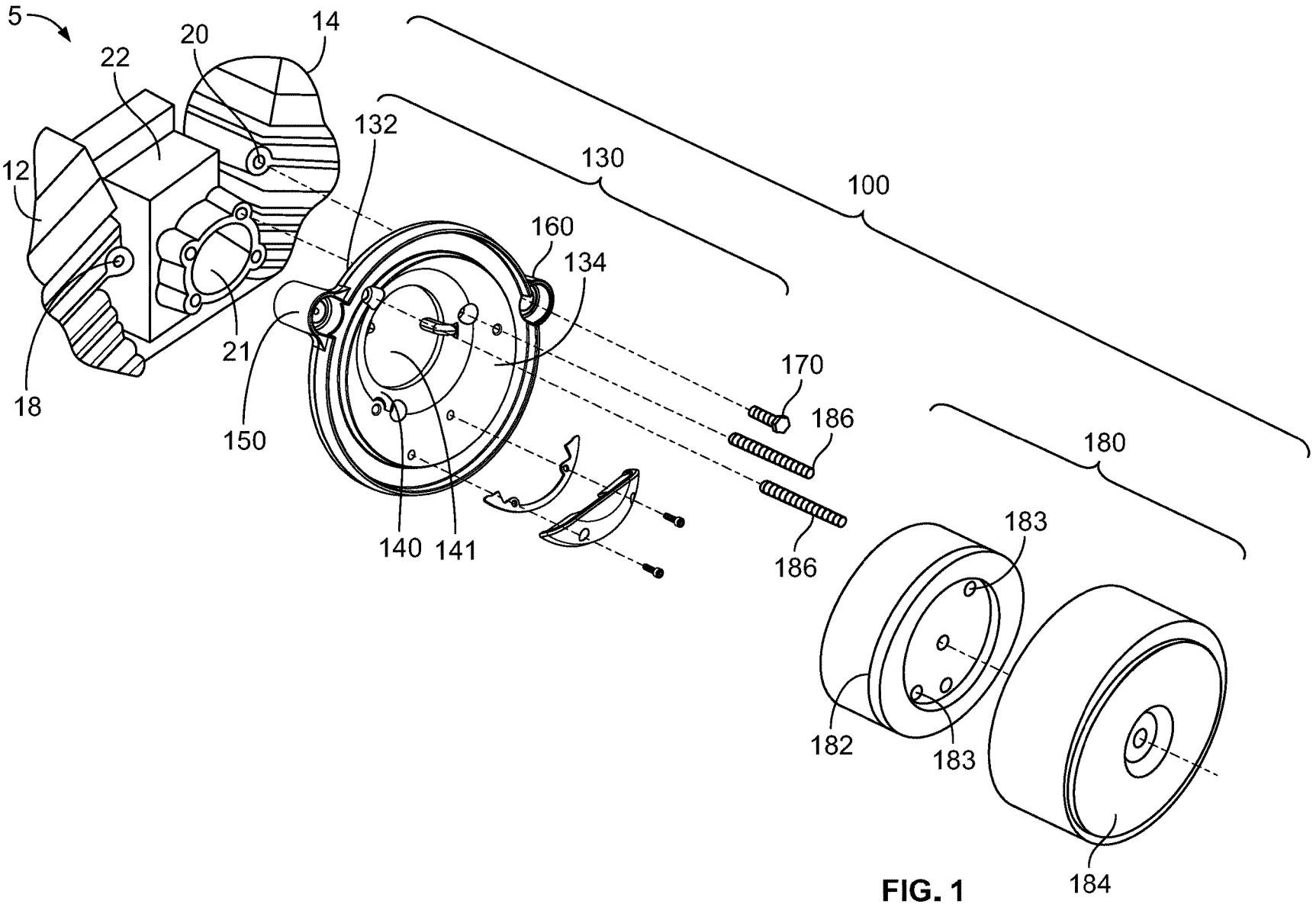
FIG. 1 is an exploded perspective view of a portion of a two-cylinder motorcycle engine with backing plate, air filter, and crankcase breather assembly.

For the purposes of promoting an understanding of the principles of the present disclosure, reference will now be made to the examples illustrated in the drawings, and specific language will be used to describe the same. It will nevertheless be understood that no limitation of the scope of this disclosure is thereby intended.

FIG. 1 illustrates a crankcase breather system 100 for use with a motorcycle engine 5, the engine 5 including at least one cylinder head 12, 14 having a communication port 18, 20 for venting a crankcase, and an air intake port 21 of a fuel system 22. The crankcase breather system 100 includes a filter assembly 180 and an air cleaner backing plate 130 adapted to couple to the filter assembly 180 and/or the engine 5. The communication ports 18, 20 are in flow communication with the cylinders (not shown) and/or the at least one cylinder head 12, 14 such that blow-by gases may be vented through the communication ports 18, 20.

The backing plate 130 includes a first side 132 and a second side 134. The first side 132 is configured to be coupled to the engine 5. The backing plate 130 further includes a venturi portion 140 defining an intake aperture 141 extending from the first side 132 to the second side 134. In an example, the intake aperture 141 is aligned with the air intake port 21 of the engine 5 when the support member 130 is coupled to the engine 5 such that air may flow through the intake aperture 141 and into the engine 5 through the air intake port 21. In another example, a cross-sectional area of the intake aperture 141 is substantially the same size to a cross-sectional area of the air intake port 21. In such an example, the cross-sectional area of the intake aperture 141 on the first side 132 of the backing plate 130 is substantially similar to the cross-sectional area of the air intake port 21. The second side 134 of the backing plate 130 is configured to be coupled to the filter assembly 180. The backing plate 130 also includes at least one flange 150, 160 for coupling the backing plate 130 to the engine 5. In some examples, the at least one flange 150, 160 couples to a respective cylinder head 12, 14 of the engine 5. In other examples, the at least one flange 150, 160 couples to a respective communication port 18, 20 of the cylinder head 12, 14. In some examples, the at least one flange 150, 160 is coupled to the respective communication port 18, 20 with a bolt 170 that extends through the at least one flange 150, 160 and is received by the respective communication port 18, 20. In some examples, the bolt 170, a portion of the at least one flange 150, 160, and/or the communication port 18, 20 are threaded such that opposed surfaces engage and contact one another and the bolt 170 is configured in such a manner to allow blow-by gasses to pass therethrough (explained in more detail with respect to FIG. 6). In some examples, the backing plate 130 includes a communication conduit 270, 280 (described in more detail below with respect to FIGS. 2 and 3) extending from each of the at least one flanges 150, 160 to an outlet 271, 281 (described in more detail below with respect to FIGS. 2 and 3) of the backing plate 130 such that blow-by gases may be in flow communication between the communication port 18, 20 and the outlet 271, 281 of the backing plate 130.

The filter assembly 180 includes an air filter 182 and a cover 184. In some examples, when the filter assembly 180 is coupled to the backing plate 130 and the backing plate 130 is coupled to the engine 5, exterior air may pass through the filter assembly 180, through the intake aperture 141, and into the engine 5 through the air intake port 21. In some examples, the filter assembly 180 is secured to the backing plate 130 with at least one alignment bolt 186. The alignment bolt 186 may pass through the backing plate 130 and into the engine 5 or may only extend into the backing plate 130 and not the engine 5. In an example, the air filter 182 includes an alignment hole 183 for each alignment bolt 186. In such an example, the alignment bolt 186 extends into the alignment hole 183 of the air filter 182 to couple the air filter 182 to the alignment bolt 186 and/or the backing plate 130. The cover 184 may then fit over the air filter 182 and couple to either the backing plate 130 and/or the air filter 182.

Figure 2:
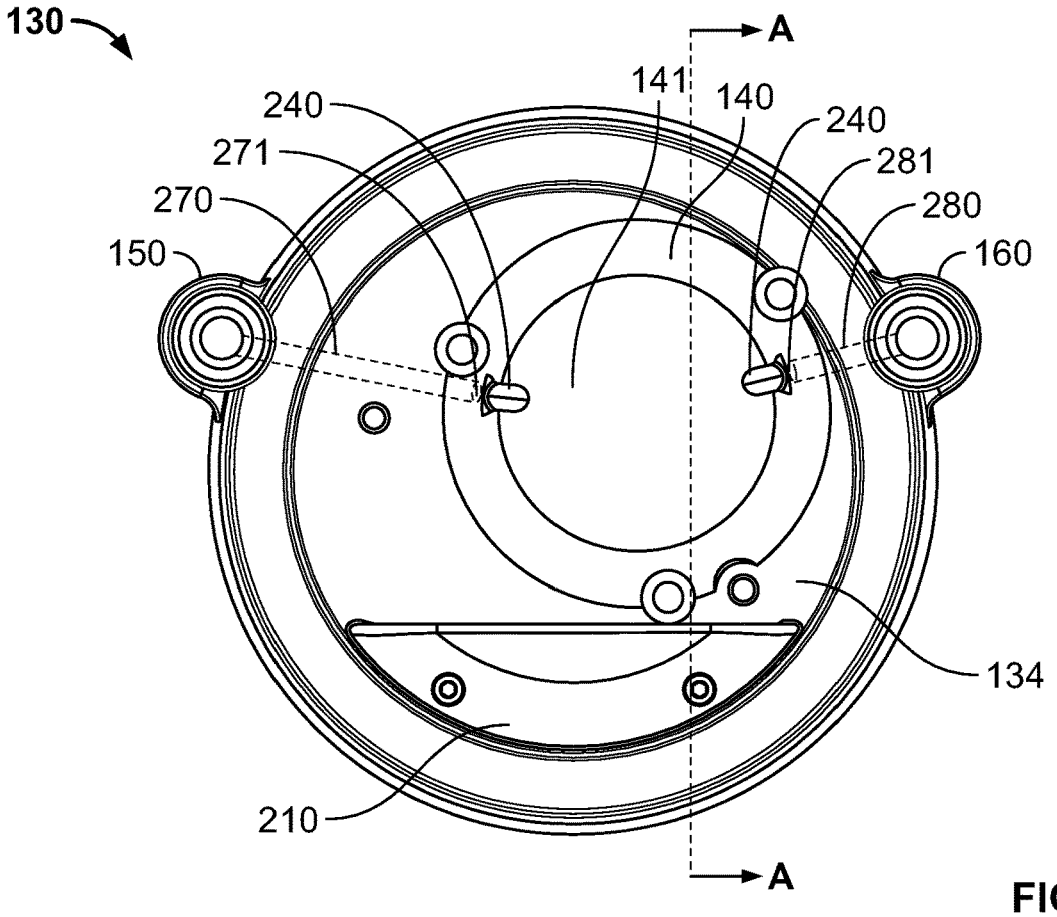
FIG. 2 is a view of the second side of the backing plate in accordance with the teachings of the present disclosure.
Figure 3:
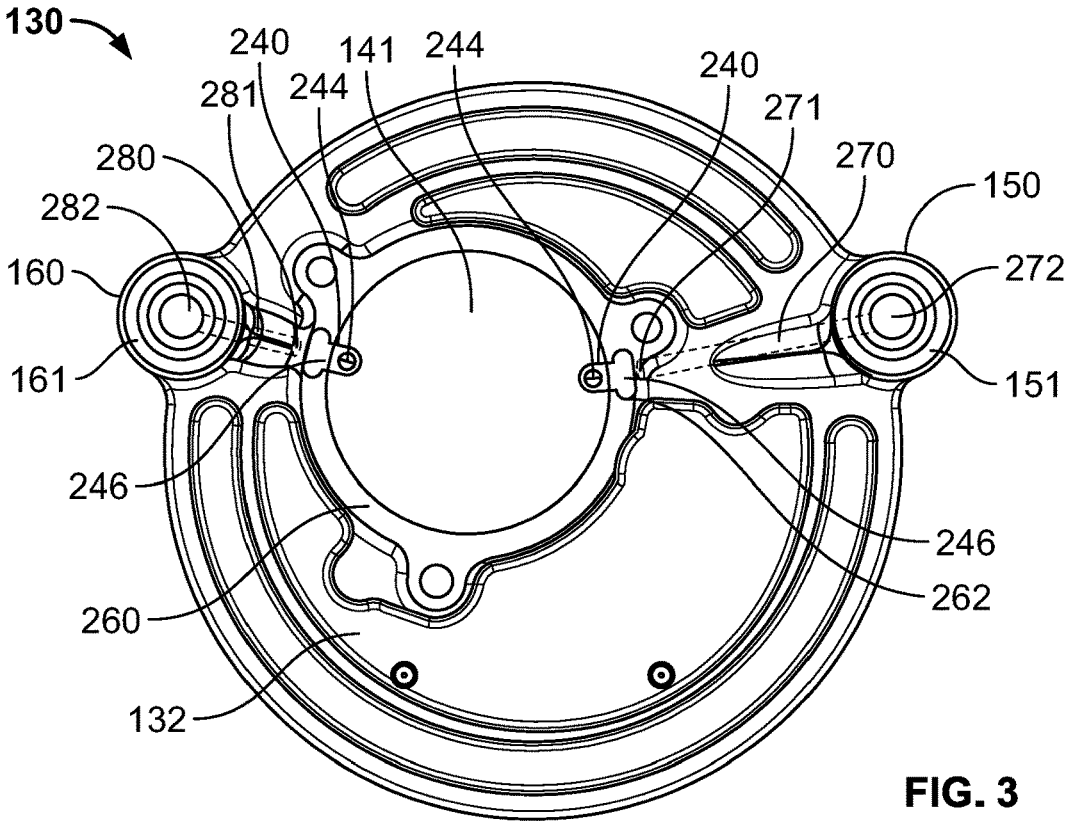
FIG. 3 is a view of the first side of the backing plate in accordance with the teachings of the present disclosure.

FIG. 2 illustrates an example of the backing plate 130 viewed from the second side 134 and FIG. 3 illustrates an example of the backing plate 130 viewed from the first side 132. The backing plate 130 further includes a reservoir 210, at least one tube 240, at least one communication conduit 270, 280, at least one outlet 271, 281, and at least one inlet 272, 282. In some examples, the at least one tube 240 includes a tube inlet 242 (FIG. 5), a tube outlet 244, and a flange 246. In further examples, the tube inlet 242 is in flow communication with the backing plate 130 outlet 271, 281. In other examples, the reservoir 210 is disposed below the intake aperture 141. In the illustrated example, the inlet 272, 282 of the backing plate 130 is included in the flange 150, 160 of the backing plate 130. In some examples, the first side 132 includes a contact surface 260. In some examples, the contact surface 260 at least partially, or fully, surrounds the intake aperture 141. In other examples, the contact surface 260 is sized and shaped such that it creates a flush point of contact with the engine 5, for example, around the air intake port 21, when the backing plate 130 is coupled to the engine 5.

Figure 4:
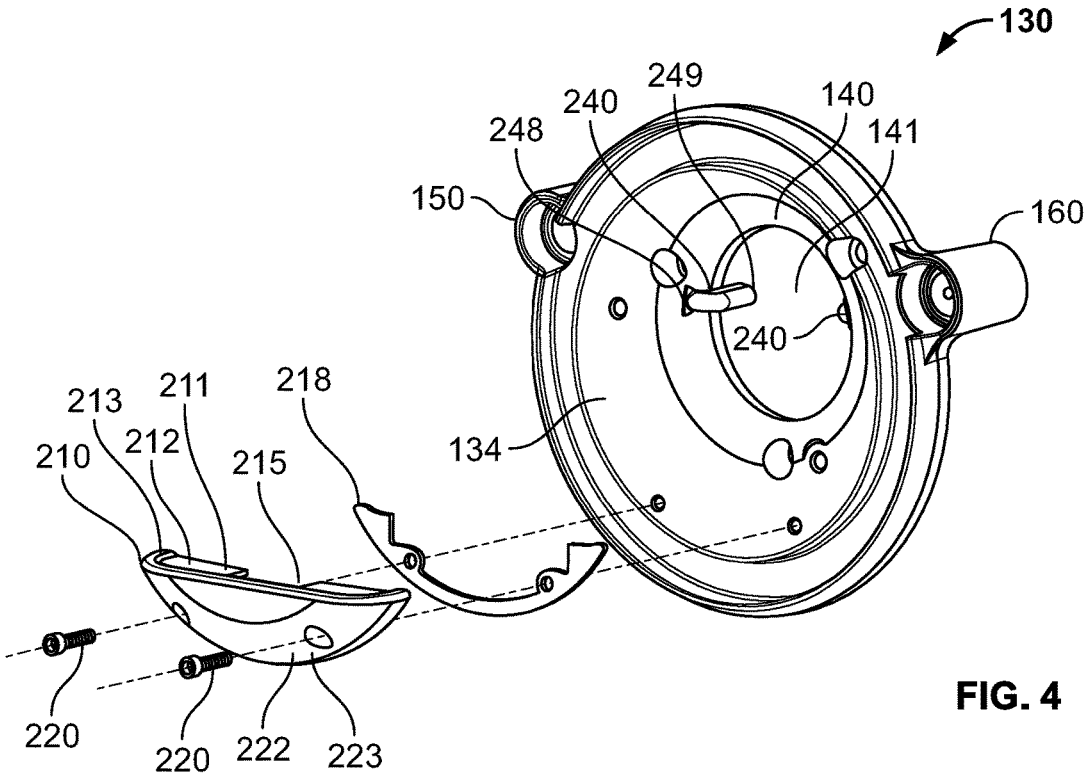
FIG. 4 is an exploded view of the second side of the backing plate in accordance with the teachings of the present disclosure.
Figure 5:
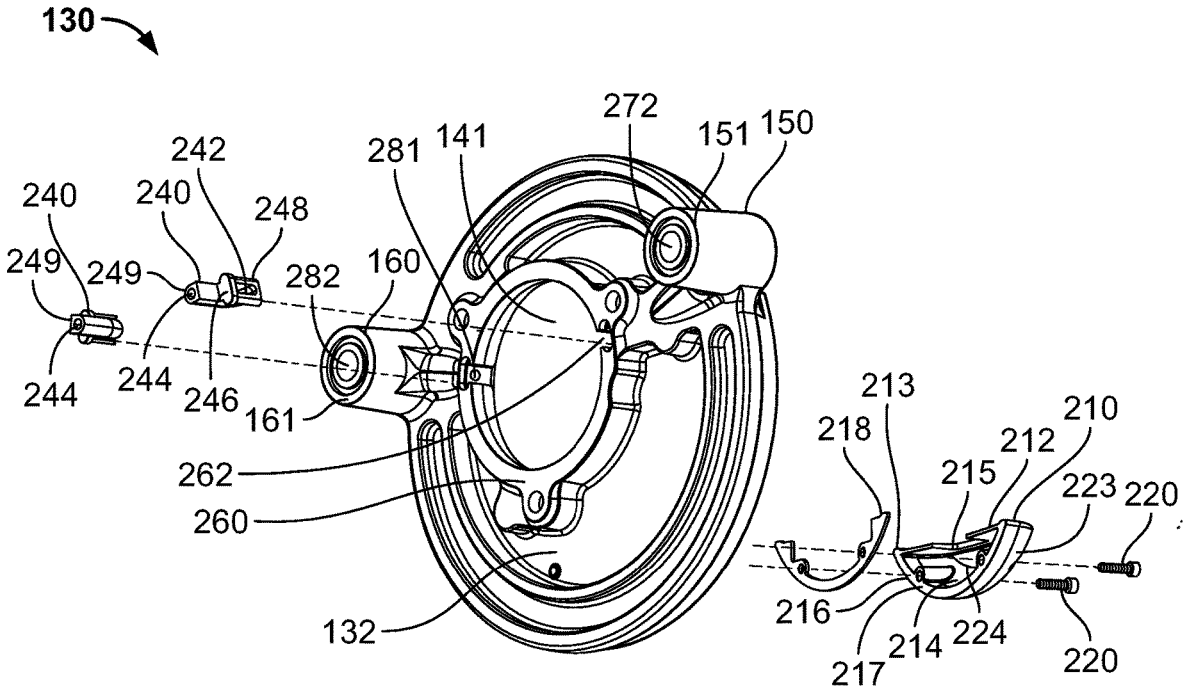
FIG. 5 is an exploded view of the first side of the backing plate in accordance with the teachings of the present disclosure.

FIGS. 4 and 5 illustrate examples of the backing plate 130 with the reservoir 210 and/or at least one tube 240 removably coupled thereto. The reservoir 210 and/or at least one tube 240 may be removably coupled to the backing plate 130 allowing for older versions (for example, those disclosed in U.S. Pat. No. 6,374,815, which issued on Apr. 23, 2002 to Cory A. Ness, et al., the disclosure of which is hereby incorporated by reference in its entirety) to be retrofitted with the reservoir 210 and/or at least one tube 240. In other examples, the reservoir 210 and/or at least one tube 240 may be manufactured as part of the backing plate 130 or permanently affixed thereto.

The reservoir 210 may include a top side 211, a guide surface 212, a lip 213, a receptacle 214, a receptacle opening 215, a first side 216 having a first surface 217, a gasket 218, and a second side 222 having a second surface 223. In examples where the reservoir 210 is removably couplable to the backing plate 130, the reservoir 210 may include an attachment device 220 that removably couples the reservoir 210 to the backing plate 130. In the illustrated example, the attachment device 220 is a screw that passes through the reservoir 210, the gasket 218, and is received by the backing plate 130. The reservoir 210 is designed to collect blow-by gasses and/or the oil droplets included therein that do not make it through the intake aperture 141 and into the air intake port 21. For example, droplets of oil (not shown) may traverse and/or fall along the venturi portion 140 and/or second side 134 of the backing plate 130 and into the receptacle 214 of the reservoir 210. In some examples, the droplets of oil pass through the receptacle opening 215 and into the receptacle 214. The guide surface 212 is located on the top side 211 and is another surface along which oil droplets can traverse to reach the receptacle 214. For example, oil droplets that do not fall directly into the receptacle opening 215 may land on the guide surface 212 and traverse along the guide surface 212 to the receptacle opening 215 and into the receptacle 214. In some examples, the guide surface 212 is angled and/or sloped towards the receptacle opening 215 to promote the oil droplets traverse from guide surface 212 to receptacle 214. In some examples, the guide surface 212 includes the lip 213, which surrounds the guide surface 212 to keep oil droplets on the guide surface 212 until they find the receptacle opening 215 (and thus the receptacle 214). In some examples, the first surface 217 directly couples to the backing plate 130. In other examples, the gasket 218 is coupled between the first surface 217 and the backing plate 130. The gasket 218 improves the liquid tight seal between the first surface 217 and the backing plate 130.

In some examples, the second surface 223 covers the entire second side 222 such that no liquid can escape the receptacle 214 from the second side 222. In some examples, the second side 222 includes a plug (not shown) that can be removed from the reservoir 210 to allow the contents of the receptacle 214 to be emptied. In the illustrated example, the guide surface 212 (and optionally the lip 213) covers the entire top side 211 but for the receptacle opening 215 such that the contents of the receptacle 214 can only escape the top side 211 through the receptacle opening 215. In some examples, the first surface 217 covers the entire first side 216 such that no liquid can escape the receptacle 214 from the first side 216. In the illustrated example, the first surface 217 does not entirely cover the first side 216, thus defining a first side opening 224. In such examples, oil (or other material) collected in the receptacle 214 can escape the receptacle from either the first side 216 (through the first side opening 224) or the receptacle opening 215. In such examples, the first surface 217 couples to the second side 134 of the backing plate 130 such that a liquid-tight seal is created between the first side 216 of the reservoir 210 and the second side 134 of the backing plate 130. In such examples, when the reservoir 210 is coupled to the backing plate 130, the contents of the receptacle 214 can only escape the receptacle 214 through the receptacle opening 215 (or other escape routes described above, such as the plug on the second side 222 of the reservoir 210).

In the illustrated example, the at least one tube 240 includes a tube conduit 250 (FIG. 6) and the tube 240 extends from the tube inlet 242 at a first end 248 of the tube 240 to the tube outlet 244 at a second end 249 of the tube 240. In some examples, the tube inlet 242 is aligned with and/or the same size as the outlet 271, 281 of the backing plate 130. In the illustrated example, the tube inlet 242 is larger than the outlet 271, 281 of the backing plate 130. For example, the tube inlet 242 may be an oval that is larger than the circular shape of the outlet 271, 281 of the backing plate 130. In some examples, the contact surface 260 of the backing plate 130 includes a notch 262 for at least one of the tubes 140 or for each tube 140. The notch 262 is sized and shaped to receive the flange 246 of the tube. In some examples, when the flange 246 is received in the notch 262, a portion of the flange 246 is flush with the contact surface 260 (see also FIG. 3). In some examples, the size of the intake aperture 141 at the first side 132 of the backing plate 130 is defined by the contact surface 260. In such examples, the air intake port 21 of the engine 5 may be sized equivalently to the intake aperture 141 at the first side of the backing plate 130. In such examples, the contact surface 260 would be coupled to and in contact with the engine such that the portion of the flange 246 that is flush with the contact surface 260 is also in contact with the engine 5. This prevents the removably coupled tube 240 from coming dislodged and entering the air intake port 21 of the engine 5.

In the illustrated example, the first end 248 of the tubes 240 are located on the venturi portion 140. In the illustrated example, the first end 248 of the tubes 240 are located at about 80 degrees and about 280 degrees on the venturi portion 140, where the topmost point of the venturi portion 140 defines zero degrees and the degrees increase clockwise around the venturi portion 140 until a total of 360 degrees is reached. In other examples, the first end 248 of the tube 240 may be located at any point on the second side 134 of the backing plate 130. In some examples, the first end 248 of the tube 240 is located on a portion of the second side 134 of the backing plate 130 that is not the venturi portion 140. In other examples, the first end 248 of the tube 240 are located between about 60 degrees and about 120 degrees of the venturi portion 140 and/or between about 240 degrees and about 300 degrees of the venturi portion 140. In other examples, the first end 248 of the tube 240 is located between about 30 degrees and about 90 degrees and/or between about 270 degrees and about 330 degrees of the venturi portion 140. In examples where the first end 248 of the tube 240 is located between 270 degrees and 90 degrees (traveling clockwise from 270 degrees to 90 degrees), gravity may assist contents pass through the tube 240.

Figure 6:
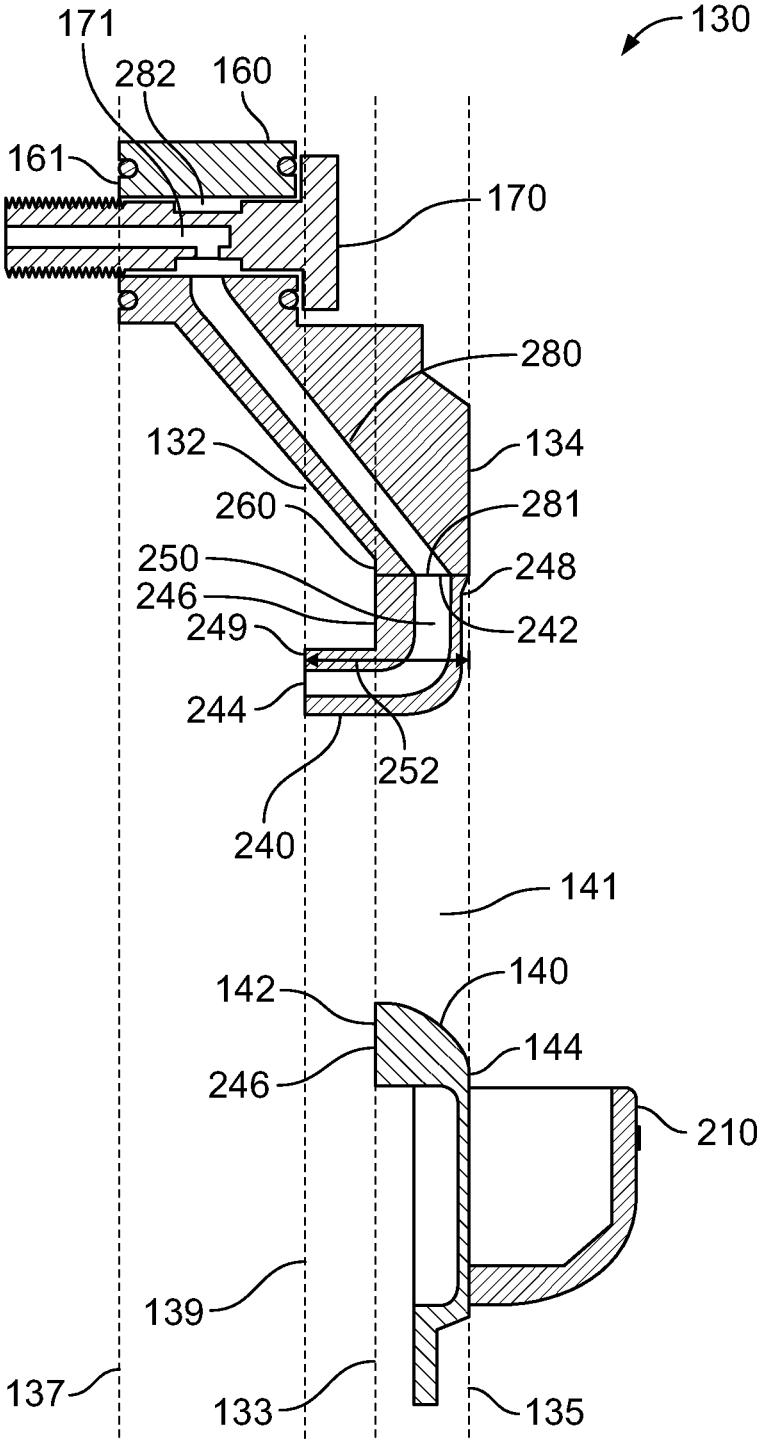
FIG. 6 is a cross sectional view of the backing plate depicted in FIG. 2-5 taken down the line A-A shown in FIG. 2.

FIG. 6 illustrates an example of the pathway by which blow-by gasses may move from the communication port 18, 20 of the engine 5 to the tube outlet 244 so that these blow-by gasses may return to the engine cylinder by being drawn, due to intake air pressure and/or the venture effect, back into the air intake port 21 of the engine 5 and/or traverse into the reservoir 210. In the illustrated example, the bolt 170 used to couple the backing plate 130 to the engine 5 includes a flow passage 171 that, when coupled to the communication port 18, 20 allows blow-by gasses to travel from the communication port 18, 20, through the flow passage 171, and into the inlet 272, 282 of the backing plate 130. In other examples, the blow-by gasses may pass directly from the communication port 18, 20 into the inlet 272, 282 of the backing plate 130. From the inlet 272, 282 of the backing plate 130, the blow-by gasses travel through the communication conduit 270, 280. The blow-by gasses exit the communication conduit 270, 280 at the outlet 271, 281 of the backing plate 130 and pass into the tube inlet 242. The blow-by gasses then travel from the tube inlet 242, through a tube conduit 250, and exit the tube 240 at the tube outlet 244. From there, the exterior air that has been pulled through the filter assembly 180 travels through the intake aperture 141 and the exterior air draws the blow-by gasses exiting the tube outlet 244 into the air intake port 21 of the engine and, for example, into the carburetor (not shown) to be mixed with fuel for burning in the engine 5. In some examples, not all blow-by gasses are drawn into the air intake port 21 by the exterior air. In such examples, the remaining blow-by gasses and/or oil droplets contained therein travel along the venturi portion 140 and/or the second side 134 of the backing plate 130 and into the reservoir 210 as described above with respect to FIGS. 4 and 5.

The tube 240 has a tube length 252 defined as the distance from the first end 248 of the tube 240 to the second end 249 of the tube 240. In some examples, the tube length 252 is less than four inches. In other examples, the tube length 252 is less than three inches. In other examples, the tube length 252 is less than two inches. In other examples, the tube length 252 is less than one inch. In some examples, the intake aperture 141 includes a first side 142 and a second side 144. In some examples, the first side 142 of the intake aperture 141 defines a first plane 133 and the second side 144 of the aperture 141 defines a second plane 135. In some examples, a third plane 137 is defined by the end 151, 161 (see also FIGS. 3 and 5) of the flange 150, 160 that terminates on the first side 132 of the backing plate 130. In further examples, the first plane 133, second plane 144, and third plane 137 are substantially parallel to a diameter of the aperture 141 and/or one or more of the other planes. In the illustrated example, the tube inlet 242 is disposed between the first plane 133 and the second plane 135. In the illustrated example, the second end 249 of the tube 240 terminates between the first plane 133 and the third plane 137. In other examples, the second end 249 of the tube 240 extends such that it terminates past the third plane 137 (i.e., on the side of the third plane 137 opposite the first plane 133 and second plane 135.

In some examples, the tube outlet 244 and/or second end 249 point towards the air intake port 21 of the engine and/or away from the second plane 135. In some examples, the tube outlet 244 and/or second end 249 point in a direction extending from the second plane 135 towards the first and/or third plane 135, 137 and in a direction that is non-parallel to the first plane 133. For example, in the illustrated example, the cross sectional area of the tube outlet 244 defines a fourth plane 139 that is parallel to the first plane 133 and/or second plane 135. In other examples, the fourth plane 139 may be disposed at any non-perpendicular angle to the first plane 133, second plane 135, and/or third plane 137 such that the tube outlet 244 still points in a direction extending from the second plane 135 towards the first plane 133.

Figure 7:
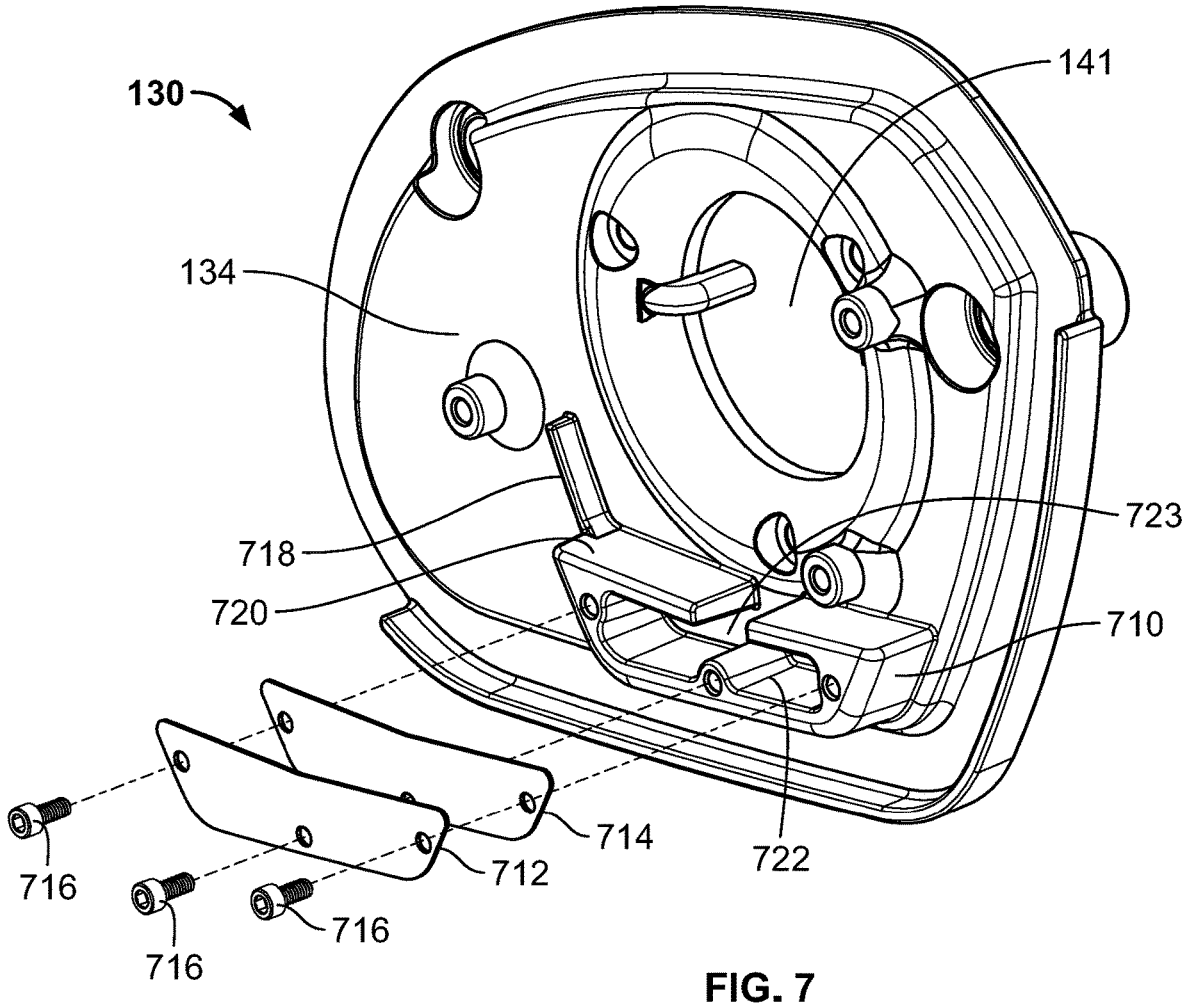
FIG. 7 is a view of another example backing plate in accordance with the teachings of the present disclosure.

FIG. 7 illustrates an example backing plate 130 where the reservoir 710 is manufactured as part of the backing plate 130 (i.e., the reservoir 710 is permanently coupled to the backing plate 130). For example, the reservoir 710 may be machined as part of the backing plate 130 or formed separately and then permanently coupled to the backing plate 130, for example, by welding. The reservoir 710 illustrated in FIG. 7 may include all the features and components as the removably coupled reservoir 210 described above in FIGS. 4 and 5. The reservoir 710 further includes a cover 712, a gasket 714, an attachment device 716, an arm 718, a guide surface 720, a receptacle 722, and a receptacle opening 723. The cover 712 encloses the receptacle 722 such that when the cover 712 is coupled to the reservoir 710, the contents collected in the receptacle 722 can only escape through the receptacle opening 723. The gasket 714 may be used in conjunction with the cover 712 to create a better liquid-tight seal between the cover 712, gasket 714, and receptacle 722. The cover 712 and/or gasket 714 may be coupled to the reservoir 710 by an attachment device 716 such as one or more screws/bolts (illustrated in FIG. 7) that pass through the cover 712, or cover 712 and gasket 714, and are received by the reservoir 710, or other means, such as being received by the reservoir 710 in a friction fit manner (e.g., like a cap to a bottle) or an interference fit. The arm 718 (which can also be included in the removably coupled reservoir 210) juts outward from the second side 134 of the backing plate 130 (e.g., in a generally perpendicular direction from the second side 134 of the backing plate 130) and extends along the second side 134 of the backing plate 130 past the guide surface 720 of the reservoir 710. The arm 718 can extend primarily horizontally or horizontally and vertically. When oil droplets (not shown) are not otherwise drawn through the intake aperture 141, the arm 718 acts as an extension of the guide surface 720 and guides oil droplets (not shown) to the guide surface 720 of the reservoir 710 so the oil droplets can make their way into the receptacle 722 (as described above with respect to FIGS. 4 and 5).

Figure 8:
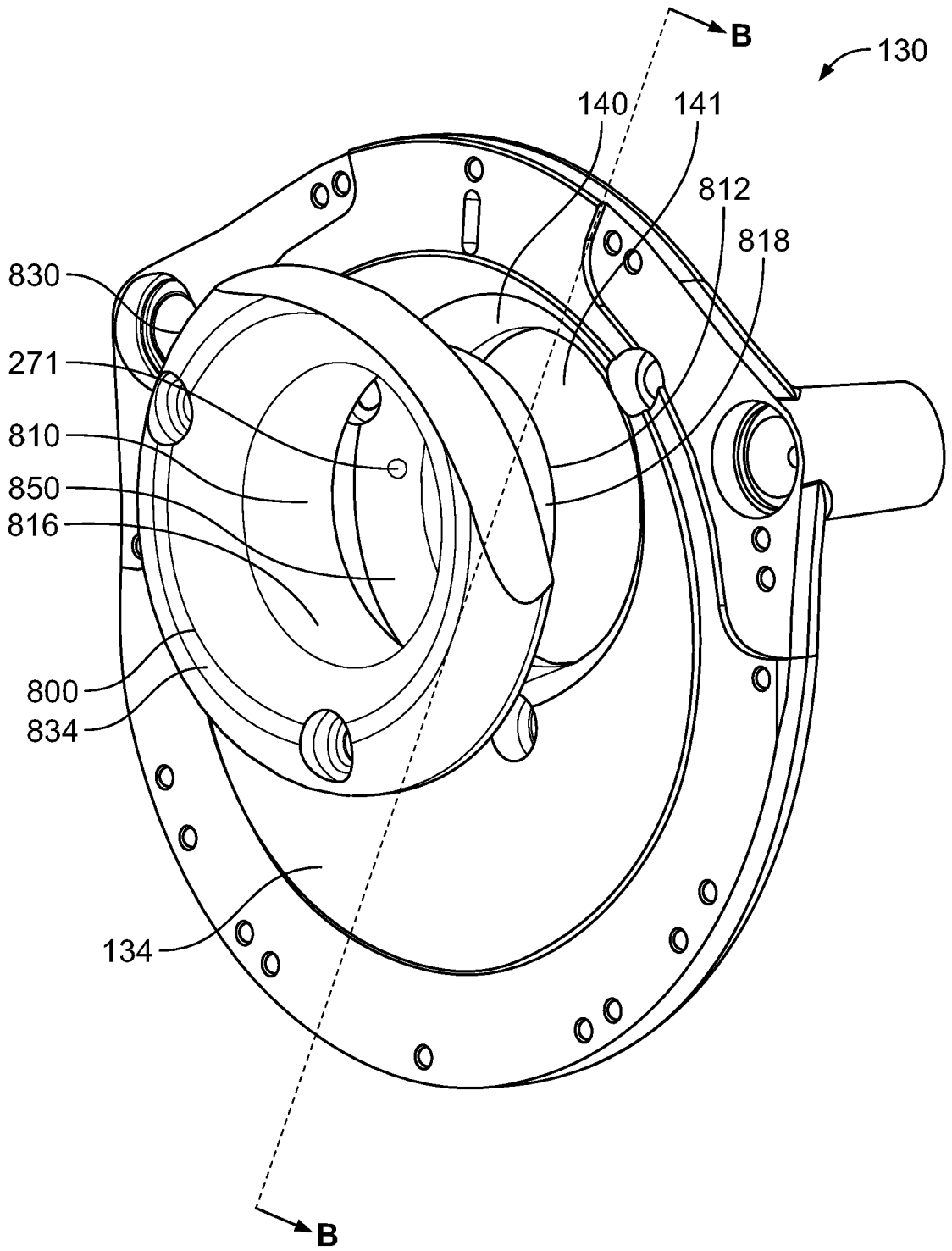
FIG. 8 is an exploded view of the second side of the backing plate in accordance with additional teachings of the present disclosure.
Figure 9:
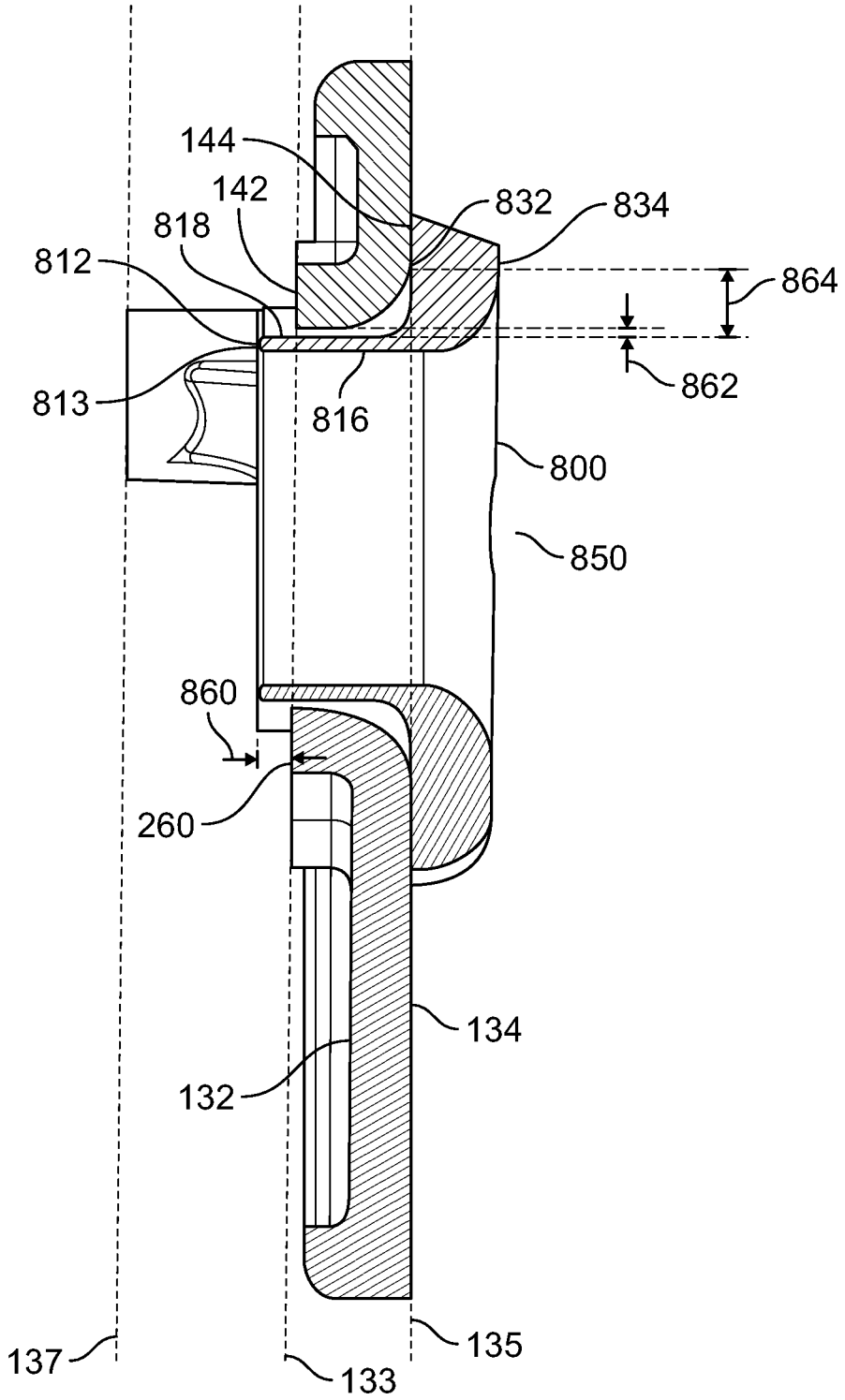
FIG. 9 is a cross sectional view of the backing plate depicted in FIG. 8 taken down the line B-B shown in FIG. 8.

FIG. 8 illustrates examples where the backing plate 130 includes a circular attachment or donut 800 and FIG. 9 illustrates a sectional view of the example in FIG. 8 along the line B-B when the donut 800 is coupled to the backing plate 130. The donut includes an inner ring 810, an outer ring 830, an inner ring first side 812, an outer ring first side 832, an outer ring second side 834, an aperture 850, an inner ring interior surface 816, and an inner ring exterior surface 818. In some examples, the donut 800 is removably coupled to the backing plate 130, for example with bolts, and in other examples, the donut 800 is permanently affixed to the backing plate 130, for example, by welding the donut 800 to the backing plate 130 or manufacturing the donut 800 as part of the backing plate 130. In some examples, the diameter of the outer ring 830 is larger than the intake aperture 141 and the diameter of the inner ring 810 is smaller than the intake aperture 141. In such examples, the outer ring first side 832 is disposed against the second face 134 of the backing plate 130 and/or the inner ring 810 extends through the intake aperture 141. In some examples, the inner ring 810 does not contact the venturi portion 140. The donut 800 aperture 850 is defined by the inner ring 810. When the donut 800 is coupled to the backing plate 130, exterior air passes through the filter assembly 180 then passes through the donut 800 aperture 850 and into the engine.

In some examples, the inner ring 810 extends through the intake aperture 141. For example, in the illustrated example, the inner ring first side 812 defines an inner ring first end 813 that terminates between the first plane 133 and the third plane 137. In other examples, the inner ring first side 812 terminates between the first plane 133 and the second plane 135. In other examples, the inner ring first side 812 extends past the third plane 137 such that it terminates on the side of the third plane 137 opposite the first and second planes 133, 135. In some examples, the inner ring first side 812 terminates between the first plane 133 and third plane 137 or beyond the third plane 137, in other examples, the inner ring first side 812 extends a horizontal distance 860 from the first side 132 of the backing plate 130. For example, in the illustrated example, the horizontal distance 860 is defined by the distance between the contact surface 260 and the inner ring first side 812. In some examples, the horizontal distance 860 is less than two inches. In some examples, the horizontal distance 860 is less than one inch. In some examples, the horizontal distance 260 is less than 0.5 inches.

In some examples, the inner ring exterior surface 818 is disposed at a distance from the venturi portion 140 and/or intake aperture 141, i.e., the inner ring exterior surface 818 does not contact the venturi portion 140 and/or intake aperture 141, when the donut 800 is coupled to the backing plate 130. For example, a first gap 862 is defined as the distance between the inner ring exterior surface 818 and the first side 142 of the intake aperture 141. In some examples, the first gap 862 is less than about 0.75 inches. In other examples, the first gap 862 is less than about 0.5 inches. In other examples, the first gap 862 is less than about 0.25 inches. In some examples, the first gap 862 is at least 0.055 inches. In other examples, a second gap 864 is defined as the distance between the inner ring exterior surface 818 and the second side 144 of the intake aperture 141. In some examples, the second gap 864 is less than 1.25 inches. In other examples, the second gap 864 is less than 1.0 inches. In other examples, the second gap 864 is less than 0.75 inches. In other examples, the second gap 864 is less than 0.5 inches. In some examples, the second gap 864 is at least 0.340 inches.

The first gap 862 and second gap 864 are important in examples (as depicted in FIGS. 8-9) where the outlet 271, 281 (281 not depicted in FIG. 8) of the backing plate 130 are located at the venturi portion 140. For example, in the illustrated example, oil and/or blow-by gases that exit the outlet 271, 281 travel along the venturi portion 140 and/or the inner ring exterior surface 818 until enough of the oil and/or blow-by gases have accumulated that the oil and/or blow-by gases located on the venturi portion 140 and/or inner ring exterior surface 818 are drawn into the engine by the air passing through the donut 800 aperture 850. In some examples, a gasket (not shown) can be used between the outer ring first side 832 and the second side 134 of the backing plate 130 to create a better seal between the donut 800 and the backing plate 130. The seal between the outer ring first side 832 and the second side 134 of the backing plate 130 (with or without the gasket) prevents oil and/or blow-by gases that have accumulated on the inner ring exterior surface 818 from traveling towards the second side 134 of the backing plate 130 and ultimately ending up on the second side 134 of the backing plate 130. In any instance where oil and/or blow-by gases accumulate upon the second side 134 of the backing plate 130, the reservoir 210 described above may be included in some examples to collect any such oil and/or blow-by gases.

In some examples, the inner ring 810 is a complete circle, i.e., the inner ring 810 extends around the entire intake aperture 141, such as in the illustrated example. Note, however, that the shape is not limited to a circle, and may be any other geometric shape, such as a square, or other multi-sided polygon. In other examples (not shown), the inner ring 810 only partially encircles the intake aperture 141. In some such examples, the inner ring 810 extends clockwise around the intake aperture 141 from about 30 degrees to about 330 degrees. In other such examples, the inner ring 810 extends clockwise around the intake aperture 141 from about 60 degrees to about 300 degrees. In other examples, the inner ring 810 extends clockwise around the intake aperture 141 from about 90 degrees to about 180 degrees.

While the disclosure has been illustrated and described in detail in the drawings and foregoing description, the same is to be considered as illustrative and not restrictive in character, it being understood that only certain examples have been shown and described and that all changes and modifications that come within the spirit of the disclosure are desired to be protected.

The invention claimed is:

1. An air cleaner backing plate for an engine that includes at least one cylinder head having a communication port for venting a crankcase and an air intake port, the backing plate comprising:

a first side adapted to be coupled to an engine having at least one cylinder head having a communication port for venting a crankcase and an air intake port;

a second side opposite the first side;

an intake aperture to be aligned with the air intake port when the first side is coupled to the engine;

a bracket inlet to be in sealed flow communication with the communication port when the first side is coupled to the engine, said bracket inlet and said communication port defining a crankcase vent channel;

a tube having a first end, a second end, a tube inlet, and a tube outlet disposed at the second end;

wherein the tube inlet is in flow communication with the crankcase vent channel; and wherein the tube outlet is directed toward the air intake port when the first side is coupled to the engine, so as to draw a gas from said crankcase vent channel as a flow of air enters said air intake port.

2. The backing plate of claim 1, wherein a first side of the intake aperture defines a first plane and a second side of the intake aperture defines a second plane that is substantially parallel to the first plane; and wherein the tube inlet is disposed between the first plane and the second plane.

3. The backing plate of claim 2, wherein the tube outlet is disposed between the first plane and the second plane.

4. The backing plate of claim 2, wherein the tube outlet is disposed on the side of the first plane opposite the second plane.

5. The backing plate of claim 1, wherein a first side of the intake aperture defines a first plane and a cross sectional area of the tube outlet defines a fourth plane that is at a non-perpendicular angle to the first plane.

6. The backing plate of claim 5, wherein the fourth plane is parallel to the first plane.

7. The backing plate of claim 1, further comprising a reservoir coupled to the second side and disposed below the intake aperture.

8. The backing plate of claim 1, the backing plate additionally comprising:

a reservoir coupled to the second side said reservoir having a opening directed toward the intake aperture, and coupled to the second side so as to be at a position so as to be disposed below the intake aperture once the first side is coupled to an engine.

9. The backing plate of claim 8 additionally comprising a bracket wherein the reservoir is removably coupled to said bracket.

10. The backing plate of claim 9, wherein the reservoir further comprises a first side to be coupled to the second side of the backing plate;

wherein the first side includes a first side opening.

11. The backing plate of claim 8 additionally comprising a bracket permanently coupled to the reservoir.

12. The backing plate of claim 8, wherein the reservoir further comprises a receptacle, a top surface, and a receptacle opening in the top surface.

13. The backing plate of claim 12, wherein the reservoir further comprises an arm extending past the top surface and along the second side.

14. The backing plate of claim 12, wherein the reservoir further comprises a lip surrounding the top surface.

15. The backing plate of claim 1, the backing plate additionally comprising:

a donut coupled to the second side, the donut including an inner ring and an outer ring;

wherein the outer ring is larger in diameter than the intake aperture; and wherein the inner ring extends at least partially through the intake aperture.

16. The backing plate of claim 15, wherein the inner ring further comprises a first end;

wherein a first side of the intake aperture defines a first plane and a second side of the intake aperture defines a second plane; and wherein the first end is disposed between the first plane and the second plane.

17. The backing plate of claim 15, wherein the inner ring further comprises a first end;

wherein a first side of the intake aperture defines a first plane and a second side of the intake aperture defines a second plane; and wherein the first end is disposed on the side of the first plane opposite the second plane.

18. The backing plate of claim 17, wherein the first side further comprises a contact surface at least partially surrounding the intake aperture that contacts the engine when the first side is coupled to the engine; and wherein a distance between the contact surface and the first end defines a horizontal distance that is less than 2 inches.

19. The backing plate of claim 15, wherein the inner ring further comprises an interior surface and an exterior surface and the intake aperture includes a first side disposed adjacent to the engine and a second side; and wherein a distance between the intake aperture first side and the exterior surface defines a first gap that is less than 0.75 inches.

20. The backing plate of claim 19, wherein a distance between the intake aperture second side and the exterior surface defines a second gap that is less than 1.25 inches.

* * * * *